US007444750B2

(12) United States Patent
Saunders

(10) Patent No.: US 7,444,750 B2
(45) Date of Patent: Nov. 4, 2008

(54) SCRAPER PLANE

(75) Inventor: Terry R. Saunders, North Gower (CA)

(73) Assignee: Lee Valley Tools, Ltd., Ottawa, ON (CA)

( * ) Notice: Subject to any disclaimer, the term of this patent is extended or adjusted under 35 U.S.C. 154(b) by 293 days.

(21) Appl. No.: 10/914,380

(22) Filed: Aug. 9, 2004

(65) Prior Publication Data

US 2005/0061398 A1 Mar. 24, 2005

Related U.S. Application Data

(60) Provisional application No. 60/494,238, filed on Aug. 11, 2003.

(51) Int. Cl.
*B27G 17/02* (2006.01)

(52) U.S. Cl. ..... 30/488; 30/489; 30/492

(58) Field of Classification Search ..... 30/487–489, 30/492

See application file for complete search history.

(56) References Cited

U.S. PATENT DOCUMENTS

| | | | | |
|---|---|---|---|---|
| 13,381 | A | 8/1855 | Bailey | |
| 97,833 | A | 12/1869 | Tanner et al. | |
| 135,341 | A | 1/1873 | Jones | |
| 157,162 | A | 11/1874 | Duncan et al. | |
| 274,600 | A | 3/1883 | Hegglund | |
| 296,207 | A | 4/1884 | Mosher et al. | |
| 0,305,603 | A | 9/1884 | Keiser | |
| 306,877 | A | 10/1884 | Traut | |
| 315,014 | A | 4/1885 | Duncan et al. | |
| 368,003 | A | 8/1887 | Polhemus | |
| 744,411 | A | 11/1903 | Sarasin | |
| 779,392 | A | 1/1905 | Bjordal | |
| 781,771 | A | 7/1905 | Gardner | |
| 821,525 | A | 5/1906 | Nordquist | |
| 837,978 | A | 12/1906 | Traut | |
| 917,568 | A | 4/1909 | Ekman | |
| 1,098,706 | A * | 6/1914 | Bodner | 30/169 |
| 1,264,350 | A | 4/1918 | Unsinger | |
| 1,332,919 | A | 3/1920 | Ritter | |
| 1,399,631 | A | 12/1921 | Lofdahl et al. | |
| 1,618,604 | A | 2/1927 | Riggs | |
| 1,726,124 | A * | 8/1929 | Rodionoff | 30/487 |

(Continued)

FOREIGN PATENT DOCUMENTS

| | | |
|---|---|---|
| CA | 554421 | 3/1958 |

(Continued)

OTHER PUBLICATIONS

John Walter, "Antique & Collectible Stanley Tools Guide to Identity and Value," 190 112 Cabinet Scraper Plane, The Tool Merchant, Marietta, Ohio (Sep. 1996).

(Continued)

*Primary Examiner*—Kenneth E. Peterson
(74) *Attorney, Agent, or Firm*—Kilpatrick Stockton LLP; Camilla C. Williams

(57) ABSTRACT

A scraper plane used in woodworking and providing a blade having an adjustable angle as well as adjustable camber. Varying the camber of the blade creates various sized regions of contact between the cutting edge of the blade and the workpiece. Variable camber provides increased control and improved function.

6 Claims, 2 Drawing Sheets

U.S. PATENT DOCUMENTS

| | | | | |
|---|---|---|---|---|
| 1,914,609 | A | 6/1933 | MacAller | |
| 2,347,570 | A * | 4/1944 | Lavietes | 30/489 |
| 2,550,766 | A | 5/1951 | Bryant | |
| 2,568,665 | A | 9/1951 | Shaler | |
| 2,645,259 | A * | 7/1953 | Ackland | 30/488 |
| 2,648,363 | A | 8/1953 | Weber | |
| 2,655,721 | A | 10/1953 | Einhorn | |
| 2,682,699 | A | 7/1954 | Merrill | |
| 2,693,029 | A | 11/1954 | Kass | |
| 2,839,109 | A | 6/1958 | Wilson et al. | |
| 3,523,348 | A | 8/1970 | Nilsson | |
| 3,710,467 | A | 1/1973 | Coon et al. | |
| 3,763,531 | A | 10/1973 | Dancsik | |
| 3,983,595 | A | 10/1976 | Knudsen et al. | |
| 4,027,388 | A | 6/1977 | Fletcher | |
| 4,492,260 | A | 1/1985 | Whiteford | |
| 4,498,516 | A | 2/1985 | Derivaz | |
| 5,459,928 | A | 10/1995 | Lynn et al. | |
| 5,694,696 | A * | 12/1997 | Lee et al. | 30/488 |
| 6,615,497 | B1 | 9/2003 | Saunders et al. | |
| 7,117,602 | B2 | 10/2006 | Saunders | |
| 2003/0037446 | A1 | 2/2003 | Saunders et al. | |
| 2004/0068878 | A1 | 4/2004 | Lin | |
| 2004/0074098 | A1 * | 4/2004 | Schwarz et al. | 30/169 |

FOREIGN PATENT DOCUMENTS

| | | |
|---|---|---|
| DE | 0046033 | 12/1887 |
| DE | 20215203 U1 | 11/2002 |
| GB | 2280868 A | 2/1995 |
| GB | 2391828 A | 4/2005 |
| SE | 149704 | 12/1951 |
| SE | 134377 | 1/1952 |

OTHER PUBLICATIONS

Picture of Stanley 112 Scraper Plane, admitted prior art.
Highland Hardware Catalog titled Woodworking Tools, Books & Supplies Fall 91/Winter 92 Catalog, p. 83, item numbered "T".
Highland Hardware Catalog titled Woodworking Tools, Books & Supplies Fall 91/Winter 92 Catalog, p. 83, item numbered "U".
Highland Hardware Catalog titled Woodworking Tools, Books & Supplies Fall 91/Winter 92 Catalog, p. 83, item numbered "V".
"Shop Solutions, Scraper Holder," ShopNotes, Issue 3, p. 26.

* cited by examiner

SCRAPER PLANE

CROSS-REFERENCE TO RELATED APPLICATIONS

This application claims priority to U.S. Provisional Patent Application Ser. No. 60/494,238 filed Aug. 11, 2003 entitled "Scraper Plane," which is incorporated herein by reference.

FIELD OF THE INVENTION

This invention relates to scraper planes used in woodworking.

BACKGROUND

Edge tools called "scrapers" have long been used in woodworking for removing thin shavings of wood or finish from a workpiece. Scrapers have been used freehand and in a variety of holders such as disclosed in U.S. Pat. No. 5,459,928. Some such prior scraper holders have a sole that contacts the workpiece.

SUMMARY

An improved scraper plane according to this invention includes a blade having an adjustable angle as well as adjustable camber. The blade is captured between the frog and lever cap, and is held in position by a lever cap screw. The frog includes an aperture adapted to receive a camber screw. The end of the camber screw bears against the blade near the cutting edge of the blade. The camber screw may be adjusted to introduce camber in the blade.

It is therefore one feature of this invention to provide variable blade camber to create various sized regions of contact between the cutting edge of the blade and the workpiece.

It is another feature of this invention to provide variable blade camber in order to provide increased control and improved function.

DETAILED DESCRIPTION

Figure 1:
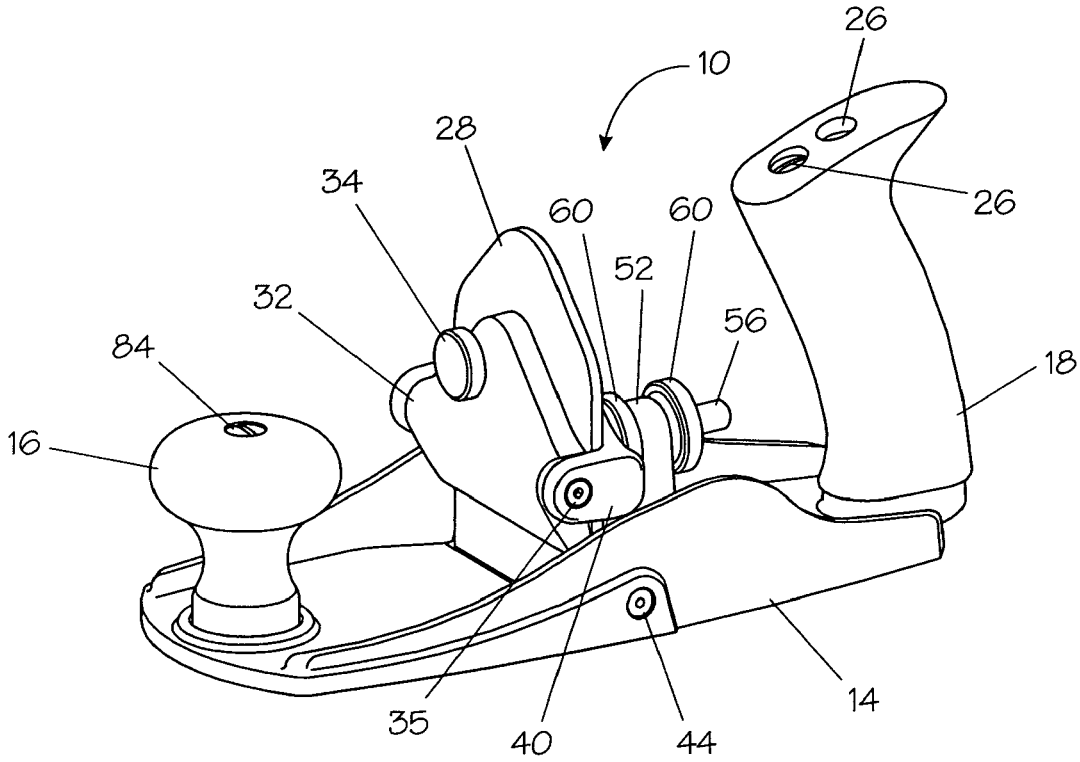
FIG. 1 is a perspective view of the scraper plane of this invention showing the top and left side.
Figure 2:
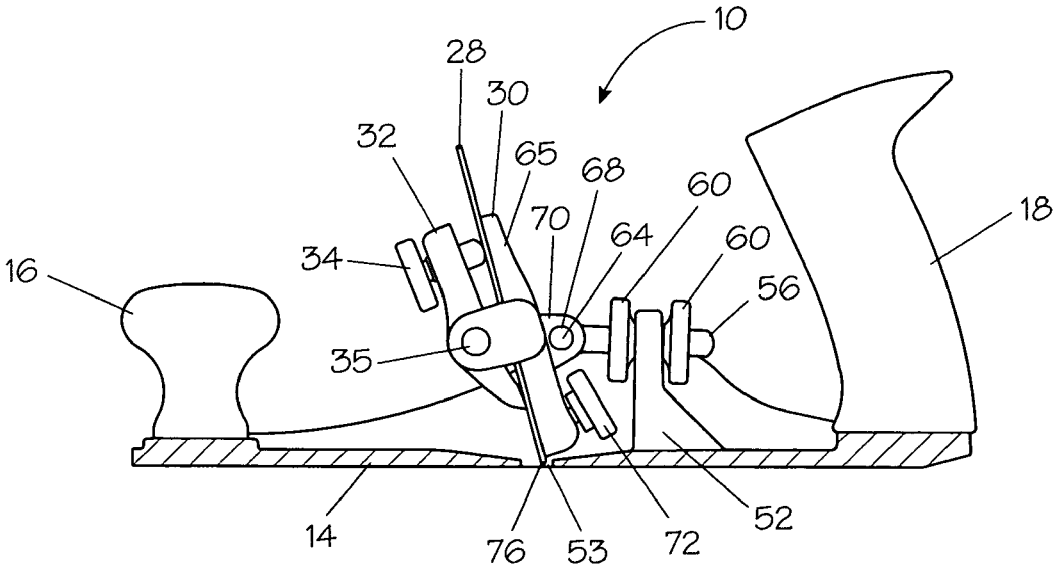
FIG. 2 is a side elevation view in partial cross-section of the scraper plane shown in FIG. 1.
Figure 3:
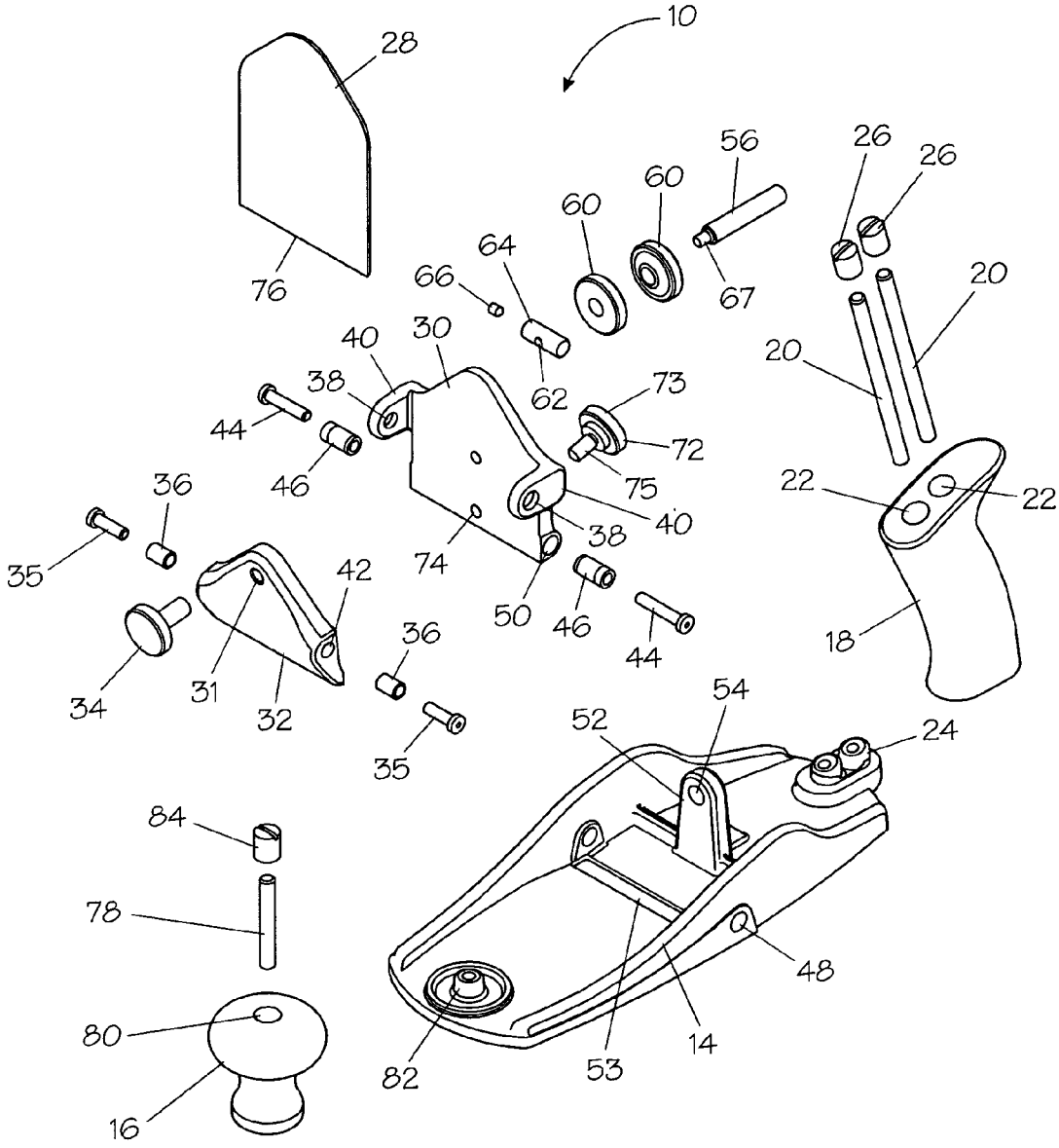
FIG. 3 is an exploded perspective view of the scraper plane shown in FIG. 1.

As may be seen by reference to FIGS. 1-3, the scraper plane 10 of this invention includes generally a plane body or casting 14, a knob 16 at the front of the plane body 14, and a handle or tote 18 at the rear. Threaded rods 20 are received in handle bores 22 and pass through the handle 18 to thread into handle base 24. Knob nuts 26 attach to the other end of rods 20, so that handle 18 is attached to the body 14.

Blade 28 is captured between frog 30 and lever cap 32, and is held in position by lever cap screw 34, which is threaded into lever cap screw aperture 31 in lever cap 32 to contact and exert pressure against blade 28. Lever cap pivot screws 35 pass through lever cap bushings 36 into apertures 38 in wings 40 of frog 30 and into side apertures 42 of lever cap 32, securing lever cap 32 to frog 30 so that lever cap 32 can pivot. Frog cap screws 44 and bushings 46 pass through apertures 48 in the side of body 14 and are received in threaded apertures 50 in frog 30, pivotally securing frog 30 to body 14.

Upstanding brace 52 protruding from body 14 behind the mouth 53 is penetrated by brace aperture 54, which receives adjustment stem 56, which passes through brace aperture 54 and is received in threaded aperture 62 of adjustment pin 64 that is pivotably positioned in arms 70 on the backside 65 of frog 30. Adjustment nuts 60 bear against brace 52 to control the protrusion of stem 56 and thereby control the angle of frog 30 and blade 28 relative to the sole of body 14. Cone point set screw 66 threaded into one end of pin 64 secures adjustment stem 56, which has a reduced diameter end 67 of adjustment stem 56 that is threaded into pin 64. Pin 64 passes through arm apertures 68 of arms 70, which project from frog 30. Adjustment nuts 60 control the angle of the blade 28.

Camber screw 72 with a knurled head 73 is received in camber aperture 74 of frog 30 near cutting edge 76 of blade 28, and the end 75 of screw 72 can bear against blade 28 relatively near its cutting edge 76. Camber screw 72 may be adjusted to introduce curvature, or camber, in blade 28. Adjusting the geometry of the blade 28 using camber knob 72 allows adjustment of the amount and shape of the blade surface that contacts the workpiece. For example, increasing the camber of the blade creates a smaller contact region of cutting edge 76 with the workpiece, while decreasing the camber increases the workpiece contact region of edge 76. This ability to adjust blade camber affords substantially more control over the cutting characteristics of the scraper plane, significantly improving its function. In alternative embodiments, camber may be adjusted using a wedge, a lever, or any other suitable mechanism rather than the screw 72 depicted in the figures.

Camber screw 72 may have any alternative head configuration, including a slotted head, phillips head, hex head, allen head, or any other suitable configuration. In one alternative embodiment, a camber screw is inserted into the opposite side of the frog aperture, so that the head of the camber screw bears against the blade after the blade is positioned between the frog and the lever cap. In another alternative embodiment, non-adjustable camber may be introduced using a protrusion or knob on the frog or by using a frog having a curved blade contacting surface, or by any other suitable configuration.

Threaded knob rod 78 passes through bore 80 in front knob 16 and is received in front knob base 82. The upper end of threaded knob rod receives knob nut 84, securing front knob 16 to the body 14.

All variations of the structures illustrated in the drawings and the materials described above are within the scope and spirit of this invention and the following claims.

The invention claimed is:

1. A scraper plane comprising:

(a) a plane body having a sole, two sides extending upward at right angles to the sole, a front end, and a rear end;

(b) a round front knob attached to the front end of the body;

(c) a pistol grip rear handle attached to the rear end of the body;

(d) a scraper blade tilted toward the front knob;

(e) two bushings, each comprising an externally threaded tube that extends through an opening in one of the two body sides and into (f) a threaded opening in a pivotable frog having two sides and secured to the plane body to pivot about a pivot axis on the two bushings, wherein the pivot axis is proximate the sole, and the frog comprises a threaded aperture proximate the sole, centrally located relative to the frog two sides and penetrating a surface of the frog against which the blade is positioned;

(g) a lever cap pivotably attached to the frog and having a lower edge; and (h) a camber screw adapted to be received in the aperture of the frog, wherein an end of the screw is adapted to bear against the blade opposite to and below the lever cap lower edge to induce camber in, and to adjust the camber of, the blade.

2. The scraper plane of claim 1, wherein the blade further comprises a cutting edge and wherein the end of the camber screw bears against the blade relatively near the cutting edge of the blade.

3. The scraper plane of claim 1, wherein the scraper blade comprises:

(a) a blade end having a cutting edge and (b) an end opposite the cutting edge having rounded corners and extending above the frog.

4. The scraper plane of claim 1, further comprising a lever cap screw and wherein the blade is captured between the frog and the lever cap and is held in position by the lever cap screw.

5. The scraper plane of claim 4, wherein the lever cap is adapted to pivot.

6. The scraper plane of claim 1, wherein the angle of the blade is adjustable.

* * * * *